United States Patent [19]

Charbonney, deceased

[11] 3,939,645

[45] Feb. 24, 1976

[54] CALENDER TIMEPIECE MOVEMENT COMPRISING THREE INDICATORS

[75] Inventor: Adrien Maurice Charbonney, deceased, late of St. Blaise, Switzerland, by Jean-Jacques Thoren, legal representative

[73] Assignee: ETA A.G. Ebauches-Fabrik, Switzerland

[22] Filed: Aug. 9, 1974

[21] Appl. No.: 496,294

[30] Foreign Application Priority Data

Aug. 9, 1973 Switzerland ..... 11522/73

[52] U.S. Cl. ..... 58/85.5; 58/58; 58/4 R; 58/5

[51] Int. Cl.[2] ..... G04B 27/08

[58] Field of Search ..... 58/58, 4 R, 4 A, 4 M, 5, 58/125 B, 126 A

[56] References Cited

UNITED STATES PATENTS

| | | | |
|---|---|---|---|
| 2,976,672 | 3/1961 | Ducommun | 58/58 |
| 3,779,001 | 12/1973 | Kocher et al. | 58/58 |

FOREIGN PATENTS OR APPLICATIONS

| | | | |
|---|---|---|---|
| 374,549 | 12/1919 | Germany | 58/58 |

*Primary Examiner*—George H. Miller, Jr.
*Assistant Examiner*—U. Weldon
*Attorney, Agent, or Firm*—Stevens, Davis, Miller & Mosher

[57] ABSTRACT

A calender time piece movement comprising three indicators, the first displaying the units figure of the date, the second displaying the tens figure of the date, and the third displaying the days of the week, an hour wheel, a driving mechanism actuated by the hour wheel and driving the indicators stepwise, and a correction mechanism, wherein the indicators are coaxial with the hour wheel, the correction mechanism comprising a rotating correction assembly and the driving mechanism comprising a calender wheel actuating the first indicator, an intermediate rotating part coaxial with the calender wheel, actuated by the first indicator and actuating the second indicator, and a shifting member coaxial with the correction assembly for shifting the third indicator.

9 Claims, 2 Drawing Figures

CALENDER TIMEPIECE MOVEMENT COMPRISING THREE INDICATORS

This invention relates to a calendar timepiece movement comprising three indicators, the first displaying the units figure of the date, the second displaying the tens figure of the date, and the third displaying the days of the week, an hour-wheel, a driving mechanism actuated by the hour-wheel and driving the indicators stepwise, and a correction mechanism.

The timepiece movements of this type which have been produced heretofore have been movements for small clocks or for watches larger than the usual wrist-watch. In certain cases, the first two indicators are coaxial, but their common axis is off-center with respect to the movement, and the third indicator is likewise off-center but in another direction. Moreover, for adjusting the positions of the indicators, e.g., for correcting the figures displayed by the first two indicators at the ends of months having less than 31 days, these known movements are equipped with push-pieces or setting-buttons.

It is the object of this invention to provide a timepiece movement of the aforementioned type which may be made in a size suitable for a wrist-watch, with a driving mechanism of small dimensions and a simplified correction device.

To this end, the movement according to the present invention, in which the indicators are coaxial with the hour-wheel, further comprises a calendar-wheel actuating the first indicator, an intermediate rotating part coaxial with the calendar-wheel, actuated by the first indicator, and actuating the second indicator, and a member coaxial with the correction mechanism for shifting the third indicator.

Figure 1:
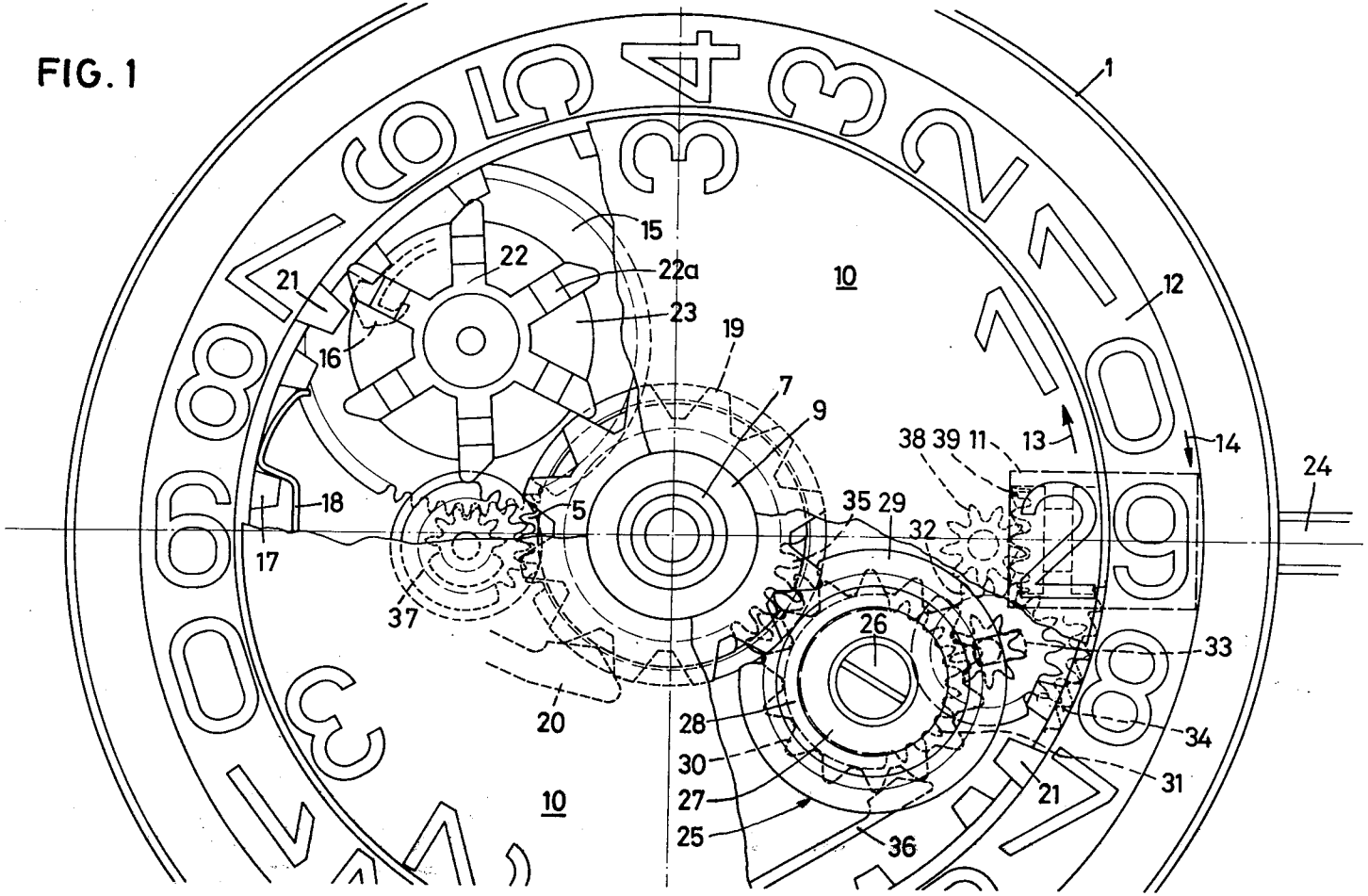
Figure 2:
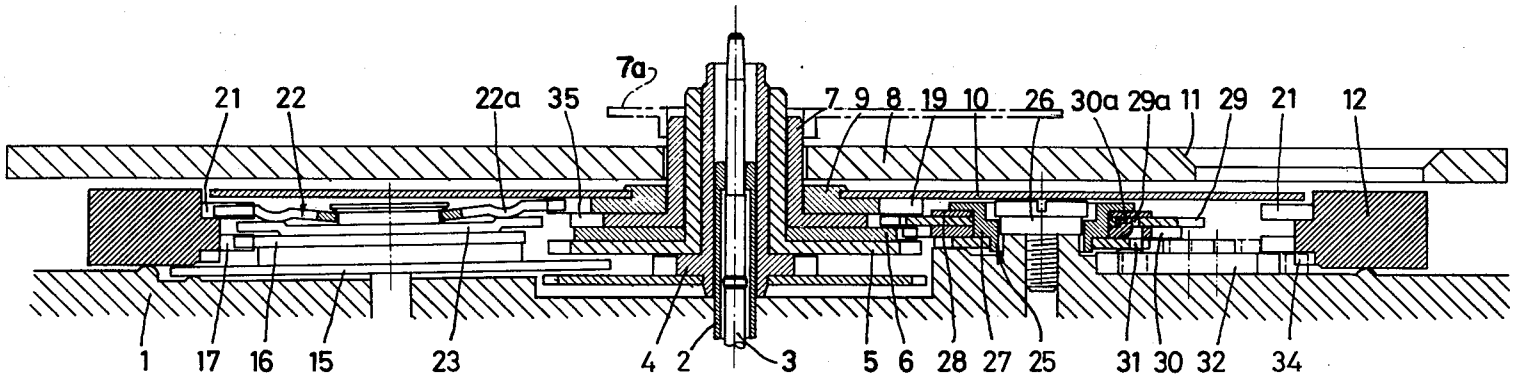

A preferred embodiment of the invention will now be described in detail with reference to the accompanying drawings, in which:

FIG. 1 is a top plan view with the dial removed and the second indicating member partially broken away, and FIG. 2 is an axial section of the calendar mechanism.

The watch movement partially illustrated in the drawing is equipped with a center seconds-hand, an hour-hand, and a minute-hand, a hand moving one-fourteenth of a rotation every twelve hours so as to indicate the day of the week and to differentiate between a.m. and p.m., and a calendar mechanism provided with two date-indicating members which display the date in a large-size aperture at the periphery of the dial.

FIG. 2 shows a base plate 1 to which is fastened a pipe 2 guiding a center seconds-arbor 3 and bearing a cannon-pinion 4. Mounted on the cannon-pinion 4 is an hour-wheel 5 supporting a disc 6 having a single tooth, the function of which will be explained further on. A wheel 7 and weekday indicator 7a are provided for indicating the days of the week, and the pipe of the wheel, like those of the cannon-pinion 4 and the hour-wheel 5, passes through a center opening in a dial 8. Between the wheel 7 and the dial 8 there is also disposed a star 9 bearing a thin disc 10 which extends immediately beneath the dial 8, and the rim of which passes in the middle of an aperture 11 situated at 3 o'clock in the dial 8. The combined member consisting of the star 9 and the disc 10 constitutes an indicator of the tens figure of the date. It is surrounded by a ring 12 which rests on the base plate 1 and bears the units figures of the date, visible in the outer half of the aperture 11. As may be seen in FIG. 1, the first date-indicator 12 bears the series of figures from 0 to 9 twice, while the periphery of the disc 10 bears the series of figures 1, 2, 3 3 times, each series being separated from the adjacent series by a blank space not bearing any indication. It would also be possible to insert a 0 in this blank space. Arrows 13 and 14 indicate the directions in which the members 12 and 10 rotate upon a shift of the date.

The means by which the movement drives the indicator members 12 and 10 will now be described. These means comprise first of all a calendar-wheel 15 which is mounted on the base plate 1 between the ring 12 and the central rotating parts 5, 6, 7 and 9 and is connected to the hour-wheel 5 by a setting-wheel 37 so as to be continuously rotated clockwise at the rate of one revolution every 24 hours. The wheel 15 carries a resilient shifting-finger 16, known per se, the design details of which are not shown in the drawing. The finger 16 cooperates with an inner toothing 17 of the ring 12; and in the embodiment described here, the toothing 17 comprises 20 teeth, or ten times as many teeth as the ring 12 has series of figures from 0 to 9. In this particular case, the number *m* of series of figures from 0 to 9 borne by the ring 12 is therefore two. A jumper 18 is engaged in the toothing 17 and fixes the position of the ring 12, so that the calendar-wheel 15 causes it to advance by one step per day, which makes the series of units figures of the date appear successively in the outer portion of the aperture 11.

At the periphery of the star 9 is a toothing 19 of trapezoidal teeth, which in the embodiment illustrated comprises twelve teeth, or a number of teeth corresponding to the number of figures and blank spaces borne by the disc 10 at its periphery. A jumper 20 cooperates with the toothing 19 to fix the position of the combined member 9, 10 when this member is in its resting position. In order to shift the member 9 every ten days, the ring 12 has, above its toothing 17, a toothing which, in the embodiment shown here, comprises two diametrically opposed teeth 21. Generally speaking, the number of teeth in this upper toothing of the ring 12 will be equal to the number of series of figures 0-9 borne by the ring 12. The teeth 21 cooperate with a six-tooth star 22 formed by blanking and bending from a steel plate and friction-mounted on the wheel 15. Also fastened between the star 22 and the mechanism which supports the shifting-finger 16 is a plate 23 against which the incurvate portions 22*a* of the arms of the star 22 are pressed. The arms of the star 22 extend into the path of the teeth 21 of the ring 12, on the one hand, and into the path of the teeth 19 of the star 9, on the other hand, so that each time a tooth 21 passes in the area of the star 22, the latter is rotated, which causes the combined member 9, 10 to advance by one step in the direction of the arrow 13. The friction of the calendar-wheel 15, or more precisely that of the plate 23, upon the star 22 keeps this star permanently in the position shown, this position being such that one of the arms of the star 22 rests against one of the teeth 19 upon clockwise rotation of the wheel 15. The jumper 20 then keeps these elements in a fixed position, the friction being weaker than the return force to which the jumper 20 is subjected.

The means just described automatically ensure the shifting of the date from the first of the month to the 30th, or even to the 31st, in succession. Upon each change from one month to the next, a correction must be made. This can be done by placing a winding-stem 24 in the hand-setting position, turning the hour and minute hands to about midnight, and then rotating the stem 24 back and forth. This back-and-forth motion is transmitted to the calendar-wheel 15, the shifting-finger 16 of which is then in a position where it meshes with the toothing 17. Because of the way in which it is disposed, the resilient finger 16 slips over the teeth 17 when the wheel 15 turns counterclockwise. The back-and-forth motion imparted to the stem 24 therefore enables the ring 12 to be advanced step-wise, and consequently enables the combined member 9, 10 to be advanced step-wise as well each time one of the teeth 21 is in the area of the star 22.

In order to facilitate this correction, however, the wrist-watch movement described here is also equipped with a rotating assembly 25 composed of a hub 27, a connecting washer 28, and three wheels 29, 30, 31 in the form of toothed discs. The hub 27 pivots about a step-screw 26 fastened to the base plate 1. Its upper collar holds in place the connecting washer 28, which is resilient and acts as an element of a friction coupling. The wheels 29 and 30 turn freely on a cylindrical bearing surface of the hub 27. They are coupled to one another by a tongue 30a blanked in the wheel 30 and bent upwards so as to engage in a corresponding opening 29a in the wheel 29. As for the wheel 31, it is driven onto the lower cylindrical bearing surface of the hub 27 and presses the wheels 29 and 30 against the washer 28. As may be seen in FIG. 2, the toothings of the wheels 29, 30, and 31 are of successively decreasing diameters, the upper toothing 29 having the largest diameter. Elements 27, 28 and 31 constitute a rotating correction assembly. The toothing 29 plays no part in the correction mechanism described here; its function will be explained further on. The toothing 30 meshes with the tooth of the disc 6 and cooperates with a jumper 36 which fixes the position of the assembly 29, 30. A rocking pinion 32, provided with two superimposed toothings, may be driven in a known manner in both directions by the winding-stem 24, when the latter is in the correction position, via a setting-wheel 38 and a clutch-wheel 39. If the pinion 32 turns clockwise, it moves away from the center of the movement through displacement of its arbor in an elongated opening 33 in the base plate 1. The lower toothing of the rocking pinion 32 comes into engagement with an asymmetrical toothing 34, thus enabling the date-ring 12 to be driven clockwise.

As already mentioned above, the calendar watch shown in the drawing also includes a day-indicator wheel 7 which is provided with a hand and is normally driven by the movement via a shifting mechanism. As may be seen in FIG. 2, a toothing 35 of the wheel 7 meshes with the upper toothing 29 of the rotating assembly 25. The rotating assembly 25 is driven one step every 12 hours by the single tooth of the disc 6 which is integral with the hour-wheel 5. The jumper 36 determines its exact resting position after each step.

If the rocking pinion 32 is driven counterclockwise by the winding-stem 24, its upper toothing comes into engagement with the toothing 31, and the indicator member 7 is actuated via the toothings 29 and 35.

Thus a simple, reliable, and compact mechanism is provided by means of which a calendar watch may be equipped with indicating members displaying the maximum of indications possible, and this in an aesthetically pleasing manner since these indicating members include a large-size date display and a day display which itself makes it possible to distinguish between a.m. and p.m. Instead of the wheel 7 having a pipe which passes through the dial 8 and bearing a hand which moves above the indications borne by the dial, it might, of course, carry a disc disposed directly beneath the dial, bearing indications which would appear in a second aperture situated between the center and the inner edge of the aperture 11.

What is claimed is:

1. A calendar time piece movement comprising three indicators, the first displaying the units figure of the date, the second displaying the tens figure of the date, and the third displaying the days of the week, an hour wheel, a driving mechanism actuated by said hour wheel and driving said indicators stepwise, and a correction mechanism, wherein said indicators are coaxial with said hour wheel, said correction mechanism comprising a rotating correction assembly and said driving mechanism comprising a calendar wheel actuating said first indicator, an intermediate rotating part coaxial with said calendar wheel, actuated by said first indicator and actuating said second indicator, and a shifting member coaxial with said correction assembly for shifting said third indicator.

2. A calendar timepiece movement in accordance with claim 1, wherein said first indicator bears the series of units figures from 0 to 9 twice and comprises a toothing with two diametrically opposed teeth, said second indicator bears the series of tens figures from 0 to 3 3 times and comprises a twelve-tooth toothing, and said intermediate rotating part is a star, the arms of which cooperate alternately with said two-tooth toothing and said twelve-tooth toothing.

3. A calendar timepiece movement in accordance with claim 1, further comprising an element of a friction coupling between said intermediate rotating part and said calendar wheel.

4. A calendar timepiece movement in accordance with claim 1, wherein said shifting member comprises two toothings, and said hour-wheel bears a single toothed disc meshing with one of said two toothings, the other of said two toothings meshing with a toothing coaxial with said hour wheel and forming part of said third indicator.

5. A calendar timepiece movement in accordance with claim 4, wherein said correction rotating assembly comprises a hub rotatingly mounted about a fixed axis, and a toothing integral with said hub and meshing with a rocking pinion, said hub having a cylindrical bearing surface, and wherein said shifting member is rotatable on said cylindrical bearing surface.

6. A calendar timepiece movement in accordance with claim 5, wherein said correction assembly comprises a friction coupling between said shifting member and said hub.

7. A calendar timepiece movement in accordance with claim 5, wherein said rocking pinion comprises an arbor engaged in an elongated opening in a frame element of the movement, said pinion being movable in translation between a first position in which it engages with said toothing integral with said hub and a second position in which it meshes with a correction toothing of said first indicator.

8. A calendar timepiece movement in accordance with claim 7, wherein said rocking pinion comprises two superimposed toothings.

9. A calendar timepiece movement in accordance with claim 7, wherein said correction toothing of said first indicator is an asymmetrical toothing.

* * * * *